United States Patent [19]

Kusz

[11] 4,385,705

[45] May 31, 1983

[54] SAFETY CLOSURE

[75] Inventor: Maximillian Kusz, Waterville, Ohio

[73] Assignee: Owens-Illinois, Inc., Toledo, Ohio

[21] Appl. No.: 310,177

[22] Filed: Oct. 9, 1981

[51] Int. Cl.[3] ..... B65D 55/02; B65D 85/56; A61J 1/00

[52] U.S. Cl. ..... 215/220

[58] Field of Search ..... 215/219, 220, 301

[56] References Cited

U.S. PATENT DOCUMENTS 3,722,727 3/1973 Gach ..... 215/220

4,095,717 6/1978 Michaelsen ..... 215/220

*Primary Examiner*—George T. Hall

*Attorney, Agent, or Firm*—John R. Nelson; Myron E. Click; David H. Wilson

[57] ABSTRACT

A two-piece child-resistant closure comprises nested inner and outer closure members. Sets of lugs on the inner surface of the outer member panel and the outer surface of the inner member panel engage each other when the outer members rotated for application of the closure to a container, but cam past each other on inclined surfaces when the outer closure is rotated in the removal direction. The panel of the outer closure member is resiliently deformable to bring the noncamming surfaces of the lugs into engagement for removal of the closure.

4 Claims, 3 Drawing Figures

SAFETY CLOSURE

BACKGROUND OF THE INVENTION

1. Field of the Invention

The invention relates to a child-resistant, or safety closure, comprising two nested closure members, which must be manipulated in a particular complex manner in order to remove the closure from an associated container.

2. Description of the Prior Art

Child-resistant closures comprising two nested closure members are well known in the art. Typically, the inner and outer members of these closures are provided with cooperating sets of lugs which engage each other when the outer member is rotated in the direction to apply the closure to an associated container. When the outer member is rotated in the removal direction, these lugs cam or ratchet past each other on inclined surfaces, so that the closure cannot be removed by mere rotation. To provide positive engagement of the inner and outer closure members for removal, the prior art has employed additional separate sets of cooperating lugs or projections, which are normally held completely separated by a resilient means. To remove these closures, the outer member must be variously squeezed, pushed, or otherwise manipulated to overcome the resilient separating means, and bring the respective removing lugs of the set into positive driving engagement.

The prior art devices thus employ different sets of cooperating lugs to apply and remove the safety closure. In many prior art devices if the separating means is damaged such as by abuse, storage with a top load or simply by repeated use, the outer closure member can fall into positive engagement with the inner member, thereby defeating the safety feature. A typical example of prior art devices of this general type is disclosed by U.S. Pat. No. 3,776,407 to Cistone. Cistone discloses two nested closure members having cooperating ratcheting lugs on each of the respective member skirt walls, and positively engaging lugs on the respective member panels. Resilient segments on at least one panel normally separate the positively engaging panel lugs.

Where continued use of a safety closure is not anticipated, as for containers of products which will be used upon one opening, low closure cost is relatively more important than fidelity of repetitive operation. Accordingly, in some applications, resilient separating means are not employed. Rather, the user must hold the outer member of the closure downwardly against the camming force to provide a frictional engagement of lugs which would otherwise cam past each other. Exemplifying such closures as U.S. Pat. No. 3,946,890 to Scuderi, U.S. Pat. No. 4,241,840 to Willis, and British Pat. No. 1,529,999 to Zeller Plastik.

In other prior art devices, at least one of the closure member panels is contoured to function as the resilient means separating sets of lugs. Such resilient panels are disclosed in U.S. Pat. Nos. 3,472,411 to Turner and 3,853,236 to Ostrowsky.

SUMMARY OF THE INVENTION

The invention provides a two-piece child-resistant closure comprising inner and outer nested closure members. Each of these closure members includes a disc-shaped panel section and an annular skirt section depending from the periphery thereof. The inner member is threaded to engage complementary threads formed on the finish of a cooperating container. The inner member is retained within the outer member by a retention bead formed on the lower skirt portion of the outer member. The inner closure member is free to rotate within the outer closure member, and has clearance for a limited amount of axial movement. The inside of the top panel of the outer closure member has a plurality of downwardly projecting lugs. A cooperating set of lugs projects upwardly from the top surface of the inner closure member top panel. Each set of lugs has surfaces perpendicular to the panel, which face each other and are engageable with each other when the outer closure member is rotated in a direction to apply the safety closure. The lug sets further include surfaces perpendicular to the panels which face each other and are engageable when the outer closure member is rotated in a direction to remove the safety closure. However, one of the lug sets further includes inclined surfaces of limited radial extent which normally prevent positive engagement of perpendicular surfaces necessary for removal of the safety closure. When the outer closure member is rotated in the removal direction, the lugs normally cam or ratchet past each other on the inclined surfaces.

To remove the safety closure, it is necessary to push downwardly on the perimeter of the outer closure member while rotating it, thereby deforming the panel of the outer closure member and bringing complementary perpendicular surfaces of the outer and inner closure members into positive engagement at a point radially spaced from the inclined camming surfaces, to transmit removal torque.

DESCRIPTION OF THE PREFERRED EMBODIMENT

Figure 1:
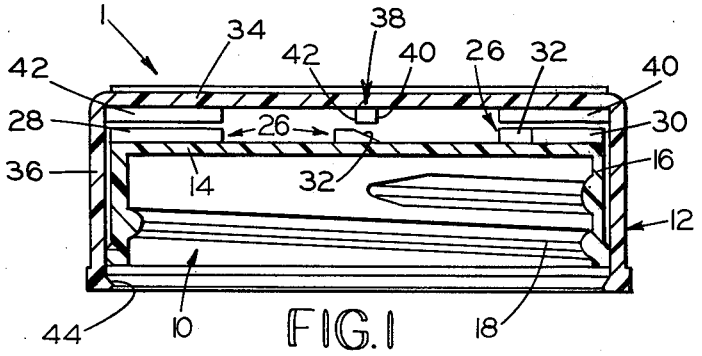
FIG. 1 is a sectional elevational view of an assembled safety closure embodying the invention.

Referring to the drawings, the safety closure 1 comprises an inner closure member 10 and an outer closure member 12. Both closure members are preferably molded of a thermoplastic material such as high density polypropylene. The closure members 10, 12 are preassembled in the nested configuration illustrated in FIG. 1 by the manufacturer.

The inner closure member 10 comprises a top panel 14 and an annular skirt 16 depending from the periphery thereof. The inside annular surface of the skirt 16 includes threads 18 formed to cooperate with complementary threads 20 formed on the finish 22 of an associated container 24.

Figure 2:
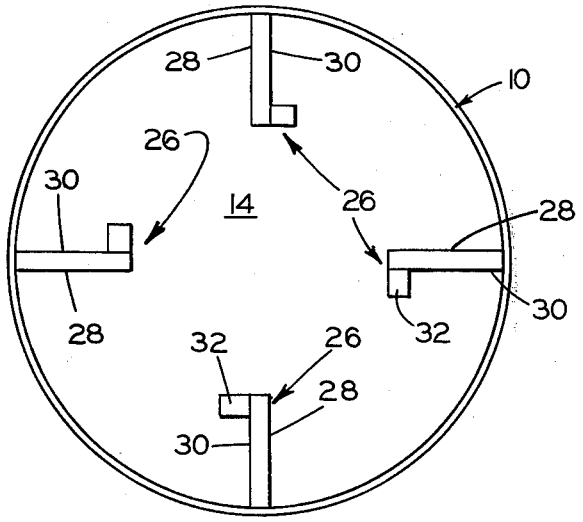
FIG. 2 is a top plan view of the upper surface of the panel of the inner closure member illustrated in FIG. 1.

As illustrated best in FIG. 2, the inner member 10 includes a plurality of circumferentially spaced lugs 26 integrally formed with and upwardly projecting from the top panel 14. The lugs 26 extend radially, and include axially extending side walls 28 and 30 which face counterclockwise and clockwise rotary directions, respectively, as seen in the top plan view of FIG. 2. The lugs 26 further include inclined surfaces 32 located adjacent the interior end of lugs 26 and are of limited radial extent. Surfaces 32 each slope downwardly from the main body of the lug 26 in a clockwise direction towards the outer surface of the top panel 14.

Referring to FIG. 1, the outer closure member 12 similarly comprises a top panel 34 and an annular skirt 36 depending from the periphery thereof. A plurality of generally radially extending lugs 38 project downwardly from the inside surface of the top panel 34 at a circumferential spacing corresponding to the L-shaped lugs 26 of the inner closure member. In the illustrated embodiment, there are four sets of matching lugs 26, 38 located in quadrants of a circle. The lugs 38 each include axially extending side walls 40 which are engageable with the side walls 28 of the L-shaped lugs 26 when the outer closure member 12 is rotated in one direction relative to the inner member 10. The lugs 38 include axial side walls 42 which are engageable with either the inclined surfaces 32 or the axial surfaces 30 of the L-shaped lugs 26 when the outer member 12 is rotated in the opposite direction.

Along the lower portion of the skirt 36 of the outer member 12 there is a radially inwardly projecting retention bead 44 constructed and arranged to retain the inner member 10 in the nested configuration within the outer member 12. The fit of the inner member 10 within the outer member 12 above bead 44 permits free relative angular movement and a limited axial movement between closure members 10 and 12.

The closure threads 18 and container threads 20 of the example shown on the drawings are right hand threads of conventional form.

When the safety closure 1 is to be applied to a container, rotation of the outer member 12 in a clockwise direction brings the lug surfaces 40 in contact with the lug surfaces 28. The flush engagement of these lug surfaces provides a positive engagement for the transmission of torque from the outer member 12 to the inner member 10.

However, when the outer closure member 12 is rotated in a counterclockwise direction for removal of the safety closure 1, the inclined surfaces 32 normally prevent positive, torque-transmitting enagement between the lugs 38 and the L-shaped lugs 26. As the outer member 12 is so rotated, the lugs 38 are cammed up and over the L-shaped lugs 26 by the inclined surfaces 32, thereby preventing necessary driving engagement between the axial surfaces 42 and 30.

Figure 3:
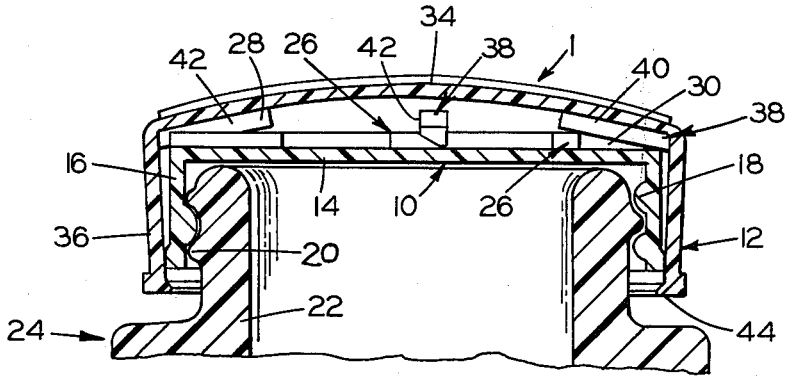
FIG. 3 is a sectional elevational view of a safety closure embodying the invention applied to a cooperating container, the panel of the outer closure member being deformed to bring cooperating sets of lugs into engagement for transmission of removal torque.

To remove the safety closure, a complex manipulation beyond the skill and dexterity of small children is required. A downwardly directed axial force must be applied to diametrically opposed areas on the periphery of the top panel 34, thereby deforming the outer closure member 12, as illustrated in FIG. 3. This peripherally applied axial force will prevent the radially disposed outer portions of one or more of the lugs 38 from being cammed upwardly beyond the axial surfaces 30 disposed adjacent to them. The deformation of the panel 34 brings the radial outer portions of the lug surfaces 42 into flush contact with the surfaces 30 of L-shaped lugs 26. A simultaneous pushing and turning manipulation results in a positive, flush, torque transmitting engagement between the lugs 26 and 38.

Although four lug sets 26, 38 are shown on the drawings, to assure proper operation of the closure 1, there need be at least two lug sets (26, 38) in the closure; and, each lug set 26, 38 must include at least two equally circumferentially spaced lugs. The appropriate angle of the inclined camming surface 32 is less than 30° measured from the plane of top panel 14.

The safety closure 1 does not require additional resilient tabs or projections to prevent engagement of the lug surfaces 30, 42. Instead, the resilience of the panel 34 itself is utilized in the operation of the safety closure 10. This feature provides a reliable low cost child-resistant safety closure yet eliminates the separate resilient elements in the design.

In view of the disclosure, further modification of the invention may become apparent to those skilled in the art, and it is intended that the scope of the invention be determined by the appended claims.

What is claimed is:

1. A child-resistant safety closure for a container having a threaded finish defining an annular opening comprising: an inner closure member including a top panel section, and an integral annular skirt depending from the periphery of said panel; and an outer closure member including a top panel and an integral annular skirt depending from the periphery of said panel of said outer closure member, means for retaining said inner closure member within said outer closure member in a nested configuration allowing free relative rotational movement therebetween and a limited axial movement of said inner closure member within said outer closure member; the top surface of the panel of said inner closure member and the inside surface of the panel of said outer closure member having complementary torque transmitting surfaces engagable for transmission of closure removal torque from the outer member to the inner member, surfaces formed on at least one of panels inclined to said panel surface and engagable with the torque transmitting surfaces of the other panel for normally preventing the torque transmitting engagement by causing the complementary surfaces to cam past each other, said panel of the outer closure member being resiliently deformable to permit at least portions of said torque transmitting surfaces of said outer closure member to engage the complementary surfaces of said inner closure member.

2. A child-resistant safety closure for a container having a threaded finish defining an annular opening comprising: an inner closure member including a top panel integrally formed with a depending annular skirt, said skirt having thread engaging means formed on the inside surface thereof for closing the container, and a plurality of lugs integrally formed on the top surface of said panel of said inner closure member, each lug having a radial, axial surface facing the direction in which said inner closure member is rotated for removal from the container, a radial axial surface facing the opposite rotational direction, and a ramp portion of limited radial extent inclined upwardly from said panel to the top of said lug in the removal direction of rotation; and an outer closure member including a top panel and an integrally formed depending annular skirt, means for retaining said inner closure member within said outer closure member in a nested configuration allowing free relative rotational movement therebetween and a limited axial movement of said inner closure member within said outer closure member, and a plurality of integrally formed lugs depending from the inside surface of said panel of said outer closure member, said latter-mentioned lugs being engageable with one set of said axial radial surfaces of the lugs of the inner closure member for transmitting closure removal torque, but normally prevented from engagement with the opposite axial radial surfaces by said inclined ramp portions, said panel of the outer closure member being resiliently deformable to permit at least portions of said outer closure member lugs to engage the radial axial surfaces of said inner closure member lugs for transmission of torque in said removal direction.

3. The safety closure defined in claim 2 wherein each of said inner closure member lugs are L-shaped, and include a first arm extending in a generally radial direction and having axial surfaces, and a second arm defined by said inclined ramp portion extending from the clockwise-facing axial surface of said first arm at an angle thereto.

4. The safety closure defined in claim 2 or 3 wherein said inclined ramp portion is located radially inward from the periphery of said panel of said inner closure member.

* * * * *